US006203044B1

(12) United States Patent
Conaway et al.

(10) Patent No.: US 6,203,044 B1
(45) Date of Patent: Mar. 20, 2001

(54) WHEELCHAIR DOCKING DEVICE

(75) Inventors: Kary D. Conaway; Aaron H. Stegeman; Ronald F. Bechler, all of George, IA (US)

(73) Assignee: Ranger All Season Corporation, George, IA (US)

( * ) Notice: Subject to any disclaimer, the term of this patent is extended or adjusted under 35 U.S.C. 154(b) by 0 days.

(21) Appl. No.: 09/432,342

(22) Filed: Nov. 2, 1999

Related U.S. Application Data

(60) Provisional application No. 60/106,678, filed on Nov. 2, 1998.

(51) Int. Cl.[7] ..... A61G 5/10

(52) U.S. Cl. ..... 280/304.1; 280/649; 297/DIG. 4; 5/86.1; 5/87.1; 5/81.1; 4/561.1; 414/921; 414/462

(58) Field of Search ..... 280/304.1, 304.5, 280/250.1, 647, 649; 297/DIG. 4; 5/86.1, 87.1, 81.1; 4/561.1; 414/921, 462, 539

(56) References Cited

U.S. PATENT DOCUMENTS 4,242,030 * 12/1980 Clement ..... 280/304.1 X
4,606,082 * 8/1986 Kuhlman ..... 297/DIG. 4
5,205,700 * 4/1993 Lin et al. ..... 414/540
5,476,241 * 12/1995 Helman ..... 297/DIG. 4
5,853,282 12/1998 Bechler et al. ..... 414/543

FOREIGN PATENT DOCUMENTS

3636492 * 4/1988 (DE) ..... B66C/1/14

* cited by examiner

*Primary Examiner*—J. J. Swann
*Assistant Examiner*—F. Zeender
(74) *Attorney, Agent, or Firm*—Kinney & Lange

(57) ABSTRACT

The present invention is a connector assembly for use in coupling a wheelchair to a wheelchair lift. The assembly includes a lift connector which has a lower arm and an upper arm, with each arm having first and second ends. An end link joins the first ends of the lower and upper arms, and the second end of each arm is free. A chair mount is removably connectable to the second free end of the lower arm of the lift connector, and is secured to a wheelchair. A lift mount is selectively positionable along the upper arm of the lift connector and is adapted to be coupled to a wheelchair lift.

14 Claims, 5 Drawing Sheets

WHEELCHAIR DOCKING DEVICE

CROSS-REFERENCE TO RELATED APPLICATION(S)

The application claims priority from U.S. Provisional Application Ser. No. 60/106,678 filed Nov. 2, 1998 for "Wheelchair Docking Device" by Kary D. Conaway, Aaron H. Stegeman and Ronald F. Bechler.

BACKGROUND OF THE INVENTION

This invention relates to personal mobility vehicle and wheelchair accessories, and more specifically, to a removable docking device attachable to personal mobility vehicles and wheelchairs enabling quick connection to a lift that permits raising, shifting, and lowering of the vehicle or wheelchair into a transport vehicle.

Personal mobility vehicles have gained widespread acceptance for use by elderly persons or persons with partial or total disabilities. Self-propelled wheelchairs and scooters are among the most popular personal mobility vehicles. As the use of self-propelled wheelchairs has increased, so had the need to transport such wheelchairs to remote locations. Wheelchairs (whether manual or self-propelled) are typically transported and stored in the storage area or trunk of another transport vehicle, such as a minivan or automobile.

The transportation and storage of wheelchairs presents numerous problems. Transporting a wheelchair, which often weighs as much or more than the user, requires its placement inside the storage area of the transport vehicle. Since most wheelchair users are elderly or partially handicapped persons, manually lifting the cumbersome wheelchair into the transport vehicle storage area can be an arduous task. To rectify these problems, many wheelchair users employ complex mechanical lifting systems to raise, shift, and lower the unwieldily wheelchair into the transport vehicle. Examples of such lifting systems include hoists, winches, cranes, lifting springs, or any other appropriate lifting system and can be found in U.S. Pat. No. 5,431,526 to Peterson, U.S. Pat. No. 4,991,810 to Androus, and U.S. Pat. No. 5,205,700 to Lin. However, the prior art mandates a sophisticated level of manual dexterity to both assemble and operate these lifting systems. Additionally, prior art lift systems require substantial user strength to properly position the wheelchair. Typically, the user must manually maneuver (using both arms) the wheelchair into the transport vehicle. Further, prior art lifting systems are structurally limited as assembly and disassembly of these complex mechanical devices is often a complicated and time-consuming procedure.

To overcome the difficulties of the previous lifts, an easily-operable wheelchair lift requiring only one hand to raise and lower the wheelchair has been developed as found in U.S. Pat. No. 5,853,282 to Bechler et al. However, the lift still requires a mounting point attached to the wheelchair. Improper attachment would result in an unbalanced wheelchair causing tipping of the chair. In addition, a permanently mounted attachment device could obstruct the use of the chair.

BRIEF SUMMARY OF THE INVENTION

In the preferred embodiment of the present invention, a connector assembly is used to couple a wheelchair to a wheelchair lift. The connector assembly includes a lift connector. The lift connector has a lower arm and an upper arm, with each arm having first and second ends. An end link joins the first ends of the lower and upper arms, and the second end of each arm is free. A chair mount is removably connectable to the second free end of the lower arm of the lift connector, and is secured to a wheelchair. A lift mount is selectively positionable along the upper arm of the lift connector and is adapted to be coupled to a wheelchair lift. Preferably, the lift mount is aligned at a point over the center of gravity of the wheelchair so that when the wheelchair is lifted using the docking device of the present invention, it does not tip.

The invention also includes the method of coupling a wheelchair to a device for elevating the wheelchair. This method includes providing a wheelchair having a chair mount permanently secured thereto, and aligning a portion of a lower arm of a lift connector to be selectively attached to the chair mount. The lift connector has an upper arm thereon which is spaced from the lower arm. The method further includes securing the lower arm of the lift connector to the chair lift, moving a lift mount along the upper arm of the lift connector, and attaching the lift mount to a device for elevating the wheelchair.

BRIEF DESCRIPTION OF THE DRAWINGS

The present invention will be further explained with reference to the attached figures, wherein like structures are referred to by like numerals throughout the several views.

While the above-identified drawings set forth several one preferred embodiment, other embodiments of the present invention area also contemplated, as noted in the discussion. This disclosure presents illustrative embodiments of the present invention by way of representation and not limitation. Numerous other modifications and embodiments can be devised by those skilled in the art which fall within the scope and spirit of the principles of this invention.

DETAILED DESCRIPTION

Figure 1:
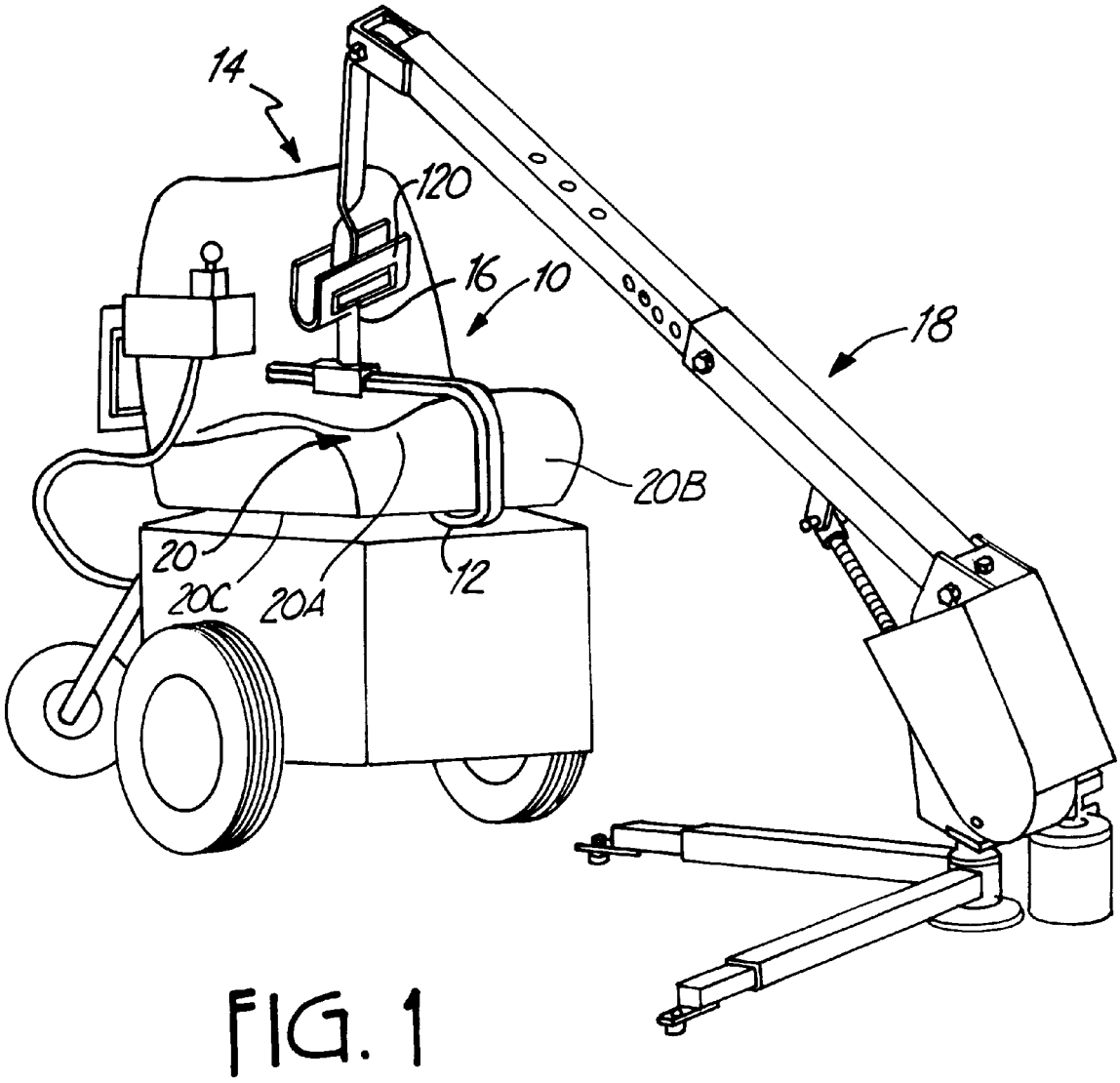
FIG. 1 is a perspective view of a motorized wheelchair being held up by the scooter lift via the inventive docking device.

A docking device of the present invention is shown generally at 10 in FIG. 1. The docking device 10 is secured at a lower end 12 to an electric wheelchair 14. An upper end 16 of the docking device 10 is connected to a scooter lift 18. The electric wheelchair 14 is lifted off the ground by the scooter lift 18 as described in U.S. Pat. No. 5,853,282 which is incorporated by reference herein. The docking device 10 provides quick attachment and unattachment of the docking device 10 to the scooter lift 18. Additionally, portions of the docking device 10 are easily separated from the wheelchair and the remaining portions are unobtrusive when the wheelchair 14 is in use. The docking device 10 is attached to the lift 18 so that the lift 18 is holding the wheelchair 14 over the balance point of the wheelchair 14. The docking device 10 thereby prevents tipping of the wheelchair 14 as it is being maneuvered in and out of a vehicle (not shown)being used to transport the wheelchair 14.

Figure 2:
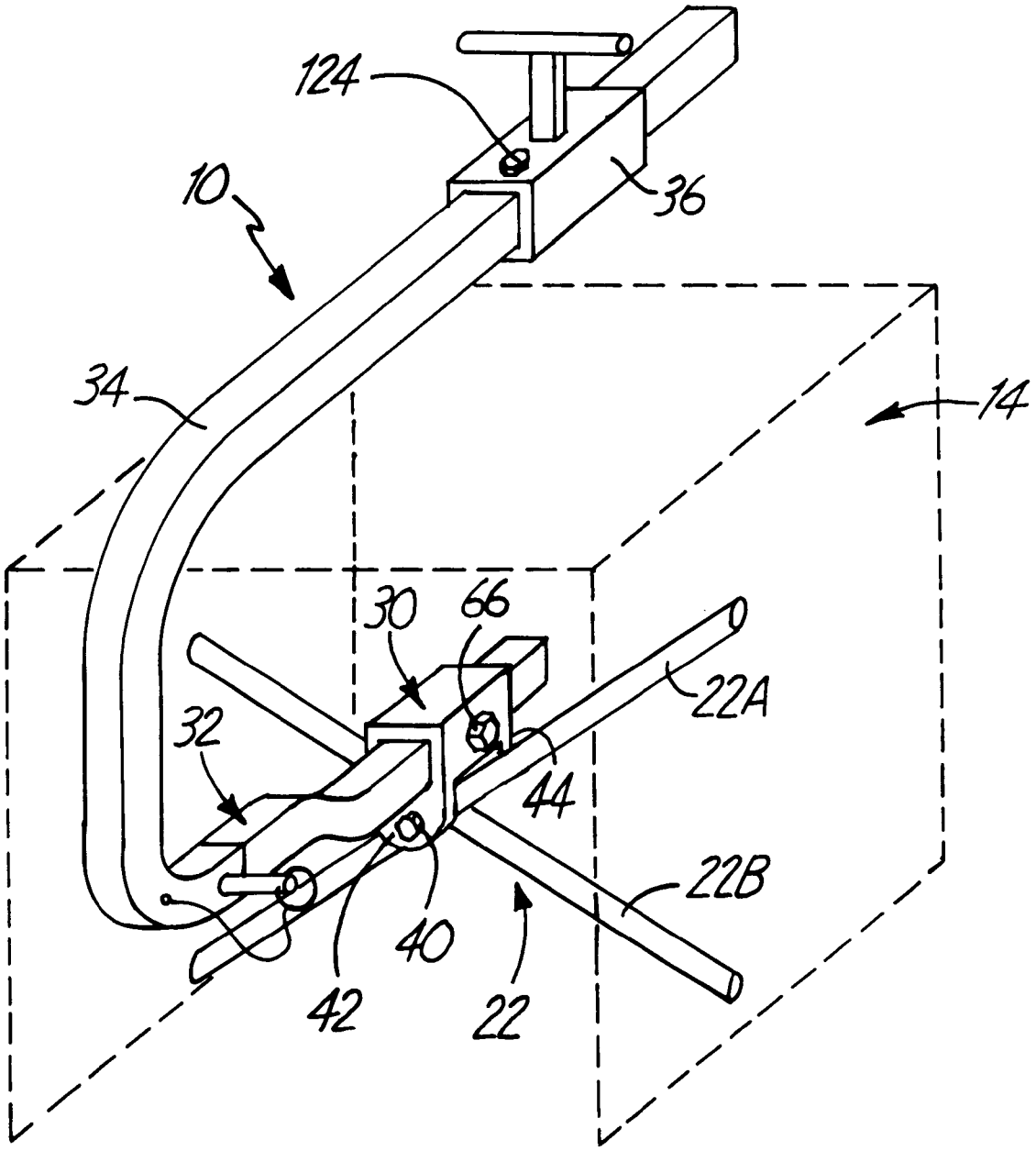
FIG. 2 is a perspective view of the inventive docking device, mounted to a cross brace portion of a wheelchair (with parts of the wheelchair removed or shown in phantom for clarity).

Preferably the docking device 10 extends around a seat portion 20 of the electric wheelchair 14. The upper end 16 extends over a horizontal top portion 20A. The docking device 10 bends downwardly over a front edge 20B and the lower end 12 thereof extends underneath a horizontal bottom portion 20C. The lower end 12 attaches to a cross brace portion 22 positioned under the seat portion 20, as best illustrated in FIG. 2.

The cross brace 22 (or "brace") is typically in the shape of an "X" and acts as a portion of the support frame for the wheelchair 14 (shown in phantom). The cross brace 22 has frame members 22A and 22B typically pinned at the intersection point with a pre-existing bolt (not shown). To attach the docking device 10, that bolt is removed and replaced. A person skilled in the art would realize, however, that the cross brace 22 of the wheelchair 14 (or any other personal mobility device) need not necessarily be in the shape of an X. Any wheelchair frame which allowed for the mounting of the docking device thereon (preferably under the seat and in the center of the chair) would not depart from the spirit and scope of the invention. It should particularly be noted that the docking device does not require that the wheelchair be motorized—it works for manual wheelchairs, self-propelled wheelchairs and even other personal mobility aids for the elderly or persons with disabilities.

Figure 3:
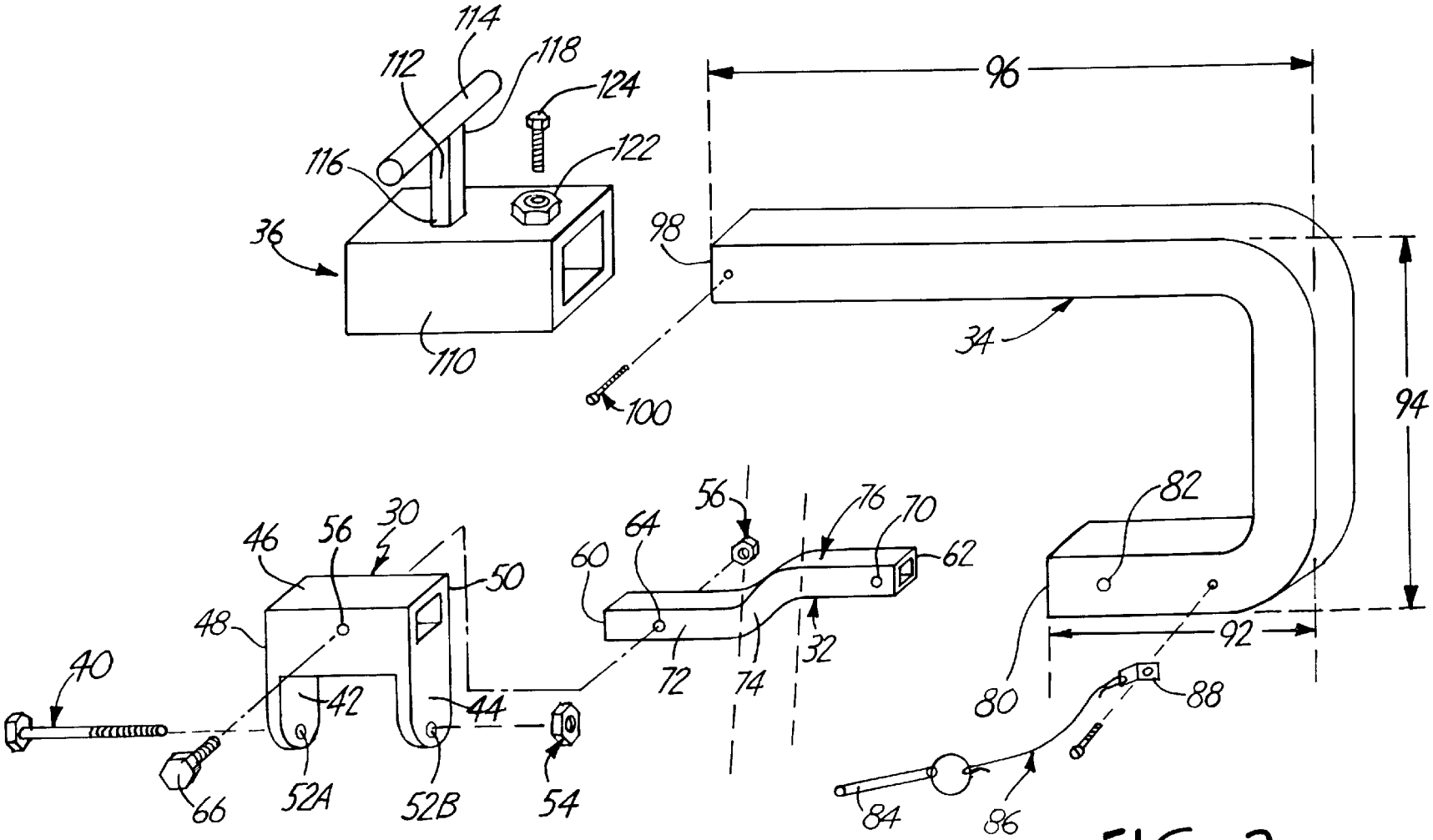
FIG. 3 is an exploded perspective view of the inventive docking device.

The docking device 10 includes a wheelchair adapter bracket 30, an offset extension tube 32, a C-arm 34, and a T slider 36. The adapter bracket 30 is mounted to the cross brace 22 by extending an adapter bolt 40 through a first arm 42 (on the adapter brace 30), further through the cross brace 22 (through the portion where the pre-existing bolt was removed) and finally through a second arm 44 (on the adapter brace 30), as illustrated in FIG. 3.

The arms 42 and 44 extend downwardly from a bracket body 46 and are preferably approximately one inch wide. Preferably, the bracket body 46 is manufactured of a metal tube having a square interior cross-section (approximately one inch by one inch). The wall thickness of the tube of the body 46 is preferably approximately twelve gauge. The arms 42 and 44 are preferably approximately 2.62 inches apart.

The bracket body 46 runs longitudinally from a first end 48 to a second end 50. The bracket body 46 is preferably approximately 3 inches long in the longitudinal direction. The first arm 42 extends downwardly from the first end 48, perpendicular to the longitudinal direction of the bracket body 46. The second arm 44 extends downwardly from the second end 50 of the bracket body 46 perpendicular to the longitudinal axis of the bracket body 46. Both arms 42 and 44 extend from the first end 48 and the second end 50 preferably approximately 2.25 inches. Adapter bolt apertures 52A and 52B extend through the first arm 42 and second arm 44, respectively. The apertures 52A and 52B are disposed through the distal end of each arm 42 and 44 (preferably approximately 1.75 inches from where the arms 42 and 44 are joined to the bracket body 46 and centered in the transverse direction). The diameter of each aperture 52A and 52B is preferably approximately 0.34 inches. The arms 42 and 44 are preferably welded to the bracket body 46.

The adapter bracket 30 is disposed over the cross brace 22 of the wheelchair 14 so that the first and second arms 42 and 44 extend on opposite sides of the cross brace 22. The adapter bolt 40 is extended through the adapter bolt apertures 52A and 52B and the cross brace 22 and secured in place using a lock nut 54. Attaching the adapter bracket 30 to the cross brace 22 in this fashion positions the adapter bracket 30 (and consequently the docking device 10 in a central position relative to the wheelchair 14).

A pair of first extension tube apertures 56 extend transversely through the bracket body 46, on opposite sides of the tube thereof. The first extension tube apertures 56 are preferably disposed in the middle (longitudinally and transversely) of opposing faces on the adaptor bracket body 46. Preferably, the apertures 56 extend through faces on the bracket body 46 so that the first extension tube apertures 56 run in a direction perpendicular to the first and second arms 42 and 44. Positioning the apertures 56 in this manner prevents the mounting of the offset extension tube 32 to the adapter bracket 30 from interfering with the cross brace 22. The first extension tube aperture 56 has a diameter of preferably approximately 0.28 inches.

The offset extension tube 32 is preferably a square metal tube extending longitudinally from an adapter end 60 to a C-arm end 62, with a length of preferably approximately 8.5 inches. The exterior cross sectional area of the tube is preferably approximately 0.75 inches by 0.75 inches and its wall thickness is preferably 11 gauge. The cross sectional area of the offset extension tube 32 is such that is can be disposed inside the bracket body 46 of the adapter bracket 30. A pair of adapter bracket apertures 64 extend transversely through the offset extension tube 32, approximately 1.5 inches from the adapter end 60 with each aperture 64 having a diameter of preferably approximately 0.28 inches. The adapter end 60 is disposed within the bracket body 46 of the adapter bracket 30 so that the adapter bracket apertures 64 in the offset extension tube 32 are aligned with the first extension tube apertures 56 in the adapter bracket 30. An extension tube bolt 66 secures the offset extension tube 32 to the adapter bracket 30. The extension tube bolt 66 extends through the first extension tube apertures 56 and the adapter bracket apertures 64 and is secured in place by a lock nut 56. A pair of C-arm apertures 70 extend transversely through the offset extension tube 32. The apertures 70 extend through the extension tube 32, preferably approximately 1.5 inches from the C-arm end 62.

The offset extension tube 32 is substantially "S" shaped. A first portion 72 of the extension tube 32 extends at least approximately three inches in a longitudinal direction towards the front of the wheelchair 14. A second portion 74 of the tube 32 projects substantially upwardly and forwardly (relative to the wheelchair 14) approximately 0.75 inches closer to the seat portion 20. A third portion 76 of the tube 32 extends generally parallel to the first portion 72. The third portion 76 of the tube 32 extends forwardly for at least approximately 3 inches.

Similar to the adapter bracket 30, the C-arm 34 is preferably formed from a square metal tube having a cross-sectional interior opening of preferably approximately one inch by one inch. The wall thickness of the tube defining the C-arm 34 is preferably approximately 12 gauge. The C-arm end 62 (male end) of the offset extension tube 32 is disposed into an extension tube end 80 (female end) of the C-arm 34. A pair of second extension tube apertures 82 are disposed transversely through the C-arm 34, preferably approximately two inches from the extension tube end 80. For assembly the adapter bracket apertures 64 of the offset extension tube 32 are aligned with the second extension tube apertures 82 of the C-arm 34. A locking pin 84 is disposed through the second extension tube apertures 82 and the adapter bracket apertures 64, effectively locking the C-arm 34 in position relative to the offset extension tube 32. Typically, the locking pin 84 has a tether attachment 86 which is fastened to the C-arm 34. The tether attachment 86 is a flexible member such as a chain or string which is secured to the locking pin 84 at one end and a bracket 88 at the other end. The bracket 88 is then screwed to the C-arm 34 using a tether screw 90. The locking pin 84 provides a readily securable, yet easily releasable means for securely connecting the offset extension tube 32 and C-arm 34.

A first portion 92 of the C-arm 34 extends forward of the front edge 20B of the seat portion 20 (shown in FIG. 1). The first portion 92 extends for preferably approximately eight inches. A second portion 94 extends upwardly (relative to the wheelchair 14) for preferably approximately 9 inches. The second portion extends generally parallel to the front edge 20B of the seat portion 20. A third portion 96 extends rearwardly for preferably approximately 19 inches. The third portion 96 of the C-arm 34 is preferably substantially parallel to and generally aligned over the first portion 92 of the C-shaped arm 34. The C-arm thereby is substantially "C" shaped, and extends from the offset extension tube 32 located under the horizontal bottom seat portion 20C upwardly past the front edge 20B and then rearwardly so as to be disposed above the horizontal top portion 20A of the wheelchair 14. The third portion 96 of the C-arm 34 terminates at a slider end 98. A stop screw 100 is disposed into the C-arm 34, preferably approximately 0.38 inches from the slider end 98.

The T-slider 36 includes a slider body 110, a post 112 and a mating dowel 114. The slider body 110 is a square metal tube having a cross-sectional interior area of preferably approximately 1.25 inches by 1.25 inches. The cross-sectional area of the open inside portion of the slider body 110 is large enough to accommodate the square tube defining the third portion 96 of the C-arm 34. The slider body 110 encompasses the third portion 96 with enough clearance so that the T-slider 36 can be moved longitudinally along the length of the third portion 96 of the C-arm. The post 112 extends longitudinally upward from the slider body 110 (relative to the seat portion 20) preferably approximately 1.25 inches. The post 112 is preferably welded to the slider body 110 at a lower end 116. The cross-sectional area of the post 112 is approximately 0.75 inches by 0.75 inches. The post 112 extends from the slider body 110 in an upward direction perpendicular to the longitudinal axis of the slider body 110 and terminates at an upper end 118. The mating dowel 114 is fixed to the upper end 118 of the post 112, preferably by welding. The mating dowel 114 runs perpendicularly to the longitudinal axis of the post 112 and in a direction perpendicular to the longitudinal axis of the third portion 96 of the C-arm 34. The dowel 114 is adapted to be engaged with a gripping portion 120 (shown in FIG. 1 and described in U.S. Pat. No. 5,853,282) of the scooter lift 18. A weld nut 122 is fixed to the slider body 110 so as to accommodate a locking bolt 124.

Figure 4:
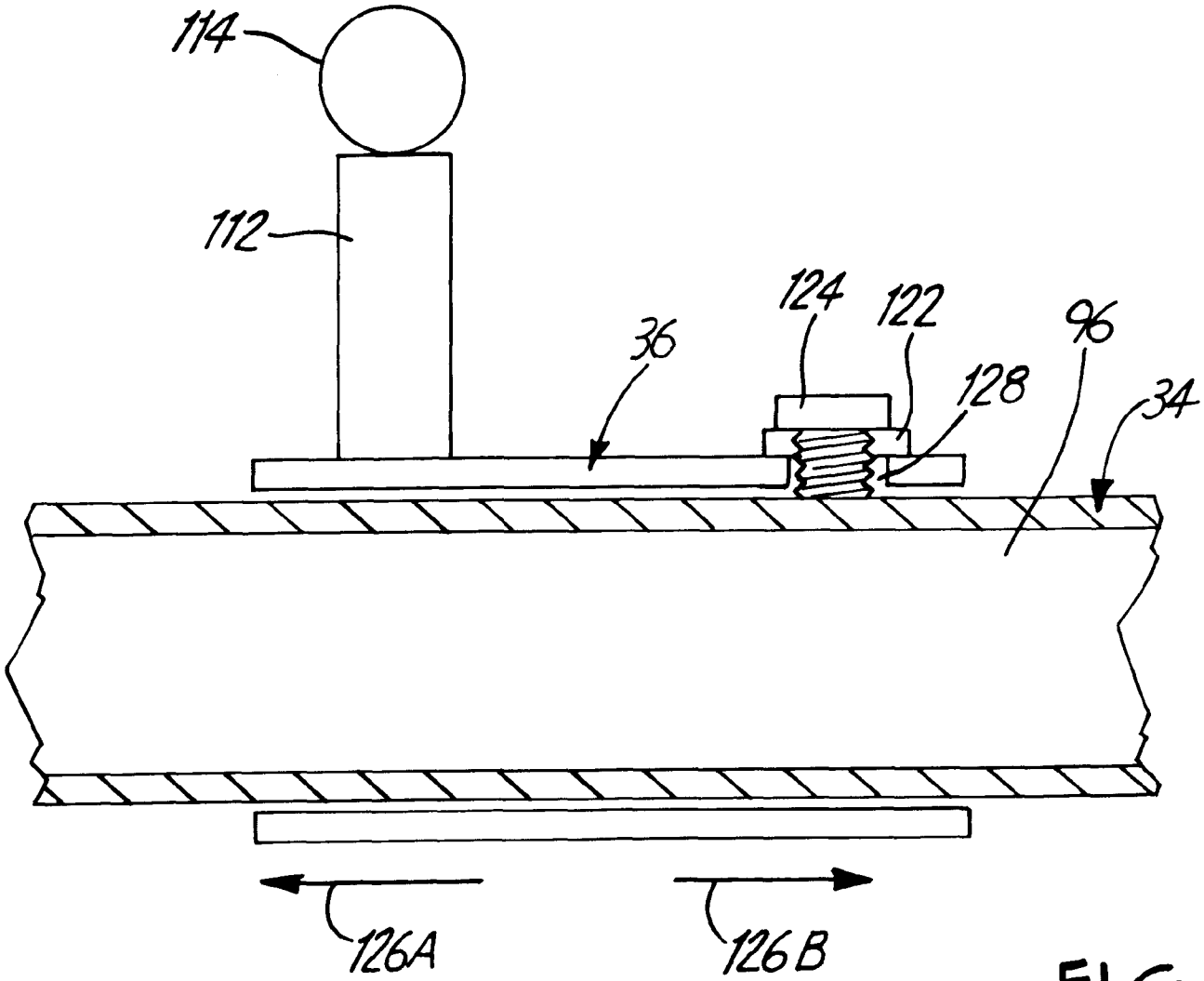
FIG. 4 is a cross-section side view of the T-slider locked in position on the C-arm.

The T-slider 36 (or lift mount) is adapted so as to be able to be slid by the operator along the third portion 96 of the C-arm 34 as illustrated in FIG. 4. The T-slider 36 is adjustable along the C-arm 34 in the longitudinal direction as illustrated by arrows 126A and 126B. Sliding the T-slider 36 in this fashion allows the operator to position the T-slider 36 along the C-arm 34 at the balance point of the wheelchair 14. This balance point would typically occur over the center of gravity of the wheelchair 14. Once the T-slider 36 has been adjusted to the balance point so that the wheelchair 14 will not twist or rotate upon lifting, the T-slider 36 is locked in position along the C-arm 34. The weld nut 122 is welded to the T-slider 36 over a slider aperture 128. The locking bolt 124 is threaded through the weld nut 122, and extends through the slider aperture 128. The locking bolt 124 engages the C-arm 34 and can be tightened so as to hold the T-slider 36 in place with respect to the C-arm 34. A person skilled in the art would realize that the weld nut 122 may not be attached, and instead the slider aperture 128 may be threaded to accommodate the locking bolt 124, or that other alternative arrangements may be provided to lock the T-slider 36 in position on the C-arm 34. The stop screw 100 (shown in FIG. 3) prevents the T-slider 36 from sliding off of the end of the C-arm 34. The lift 18 is attached to the T-slider 36 and the chair 14 may be raised into a vehicle or lowered out of a vehicle. Since the C-arm 34 is positioned so that the third portion 96 extends directly above the first portion 92, the chair 14 is prevented from tipping from side to side. After finding the balance point along the third portion 96 of the C-arm 34 and locking the T-slider 36 in place, the chair 14 is prevented from tipping from front to back.

Figure 5:
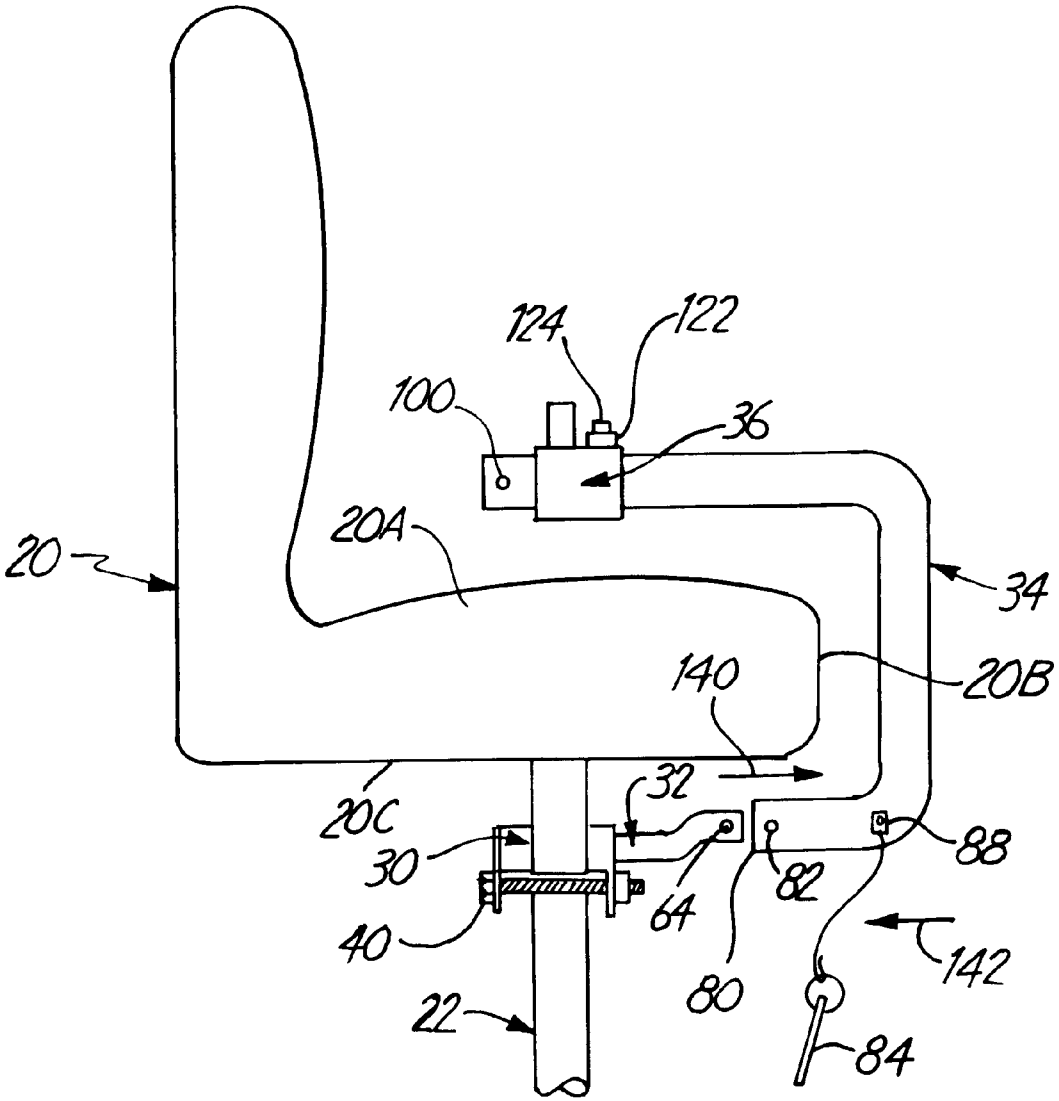
FIG. 5 is a side view of the inventive docking device attached to a wheelchair with the C-arm separated from the offset extension tube.

As shown in FIG. 5, the C-arm 34 (or lift connector) can be removed from the adapter bracket 30 and offset extension tube 32 (or chair mount) portion of the docking device 10 by removing the locking pin 84 from the second extension tube apertures 82 on the C-arm 34 and the adapter bracket apertures 64 on the offset extension tube 32 and pulling in a forward direction (as indicated by arrow 140). Once the C-arm 34 and the T-slider 36 portion of the docking device 10 have been removed, a user can sit in the seat portion 20 of the wheelchair 14 without interference from the docking device 10. The adapter bracket 30 and offset extension tube 32 portions of the docking device 10 remain attached to the wheelchair 14, but remain out of the way underneath the front edge 20B of the seat portion 20. Re-attaching the C-arm 34 and the T-slider 36 requires sliding the extension tube end 80 of the C-arm 34 over the offset extension tube 32 rearwardly (in the direction of arrow 142). The locking pin 84 is then re-inserted through the second extension tube apertures 82 and the adapter bracket apertures 64, effectively locking the upper portion of the docking device 10 in place and allowing easy access to attach the lift 18 to the T-slider 36.

A person skilled in the art would realize that although dimensions have been provided for the preferred embodiment of the inventive docking device 10, alternate dimensions may also be used without departing from the inventive spirit and scope. Additionally, square metal tubes need not be used to practice the invention. A person skilled in the art would realize that other tubing or bracket shapes manufactured from a variety of materials (plastic, for example) can be utilized. In addition, although one specific attachment arrangement is illustrated form connecting the inventive docking device to a lift (mating dowel 114/post 112 and gripping device 120), numerous other connecting arrangements will work to releasably secure the lift to the docking device over the center of gravity of the wheelchair. Indeed, numerous other arrangements will work to practice the invention of finding and then using the central balance point of the wheelchair for ease in lifting the wheelchair. That invention and its method of use should not be limited in scope by the particular form or mechanics of the embodiment used to illustrate it.

Although the present invention has been described with reference to preferred embodiments, workers skilled in the art will recognize that changes may be made in form and detail without departing from the spirit and scope of the invention.

What is claimed is:

1. A connector assembly for use in coupling a wheelchair to a wheelchair lift, the connector assembly comprising:

a lift connector having a lower arm and an upper arm, each arm having first and second ends, and an end link joining the first ends of the lower and upper arms, the second end of each arm being free;

a chair mount secured to a wheelchair, the chair mount removably connectable to the second free end of the lower arm of the lift connector; and a lift mount on the upper arm of the lift connector, the lift mount being selectively positionable along the upper arm and adapted to be coupled to a wheelchair lift, wherein the upper arm extends over a seat of the wheelchair, the lower arm extends under the seat, and the end link extends around the seat when connecting the wheelchair to the wheelchair lift.

2. The connector assembly of claim 1 wherein the lower and upper arms are generally parallel.

3. The connector assembly of claim 1 wherein the upper arm extends generally over the lower arm.

4. The connector assembly of claim 1 wherein the lift mount is slidably mounted on the upper arm of the lift connector.

5. The connector assembly of claim 4, and further comprising:

a limit stop for preventing separation of the lift mount from the upper arm of the lift connector.

6. The connector assembly of claim 1 wherein the chair mount aligns the second free end of the lower arm of the lift connector centrally relative to the wheelchair.

7. The connector assembly of claim 1 wherein the chair mount is secured adjacent the center of the wheelchair.

8. The connector assembly of claim 1 wherein the chair mount is secured to the wheelchair under the seat thereof.

9. The connector assembly of claim 1 wherein the lift mount is fixably secured to the upper arm of the lift connector at a point thereon which is above the center of gravity of the wheelchair.

10. The connector assembly of claim 1 wherein the second free end of the lower arm is a female connector and the chair mount includes a male connector recievable within the female connector.

11. The connector assembly of claim 10, and further comprising:

a lock mechanism for securing the lift connector to the chair mount when the female and male connectors are coupled together.

12. The connector assembly of claim 1 wherein the chair mount includes a first section fixedly mounted to the chair and a second extension section secured to the first section, the second extension section being removably connectable to the second free end of the lower arm of the lift connector.

13. The connector assembly of claim 1 wherein the chair mount is secured to a frame of the wheelchair at a point where crossing frame members intersect.

14. The connector assembly of claim 1 wherein at least a portion of the upper arm extends over the center of gravity of the wheelchair.

* * * * *